United States Patent [19]

Suemura et al.

[11] 4,348,229

[45] Sep. 7, 1982

[54] ENAMELLING STEEL SHEET

[75] Inventors: Kenichiro Suemune; Masami Osawa, both of Kitakyusyu, Japan

[73] Assignee: Nippon Steel Corporation, Tokyo, Japan

[21] Appl. No.: 180,486

[22] Filed: Aug. 22, 1980

[51] Int. Cl.[3] ..... C22C 38/06

[52] U.S. Cl. ..... 75/124; 75/126 B; 75/126 J; 75/126 K; 75/126 P; 75/126 Q; 148/12 C

[58] Field of Search ..... 75/124, 126 A, 126 D, 75/126 J, 126 K, 126 Q; 148/12 C

[56] References Cited

U.S. PATENT DOCUMENTS 2,737,455 3/1956 Kirby et al. ..... 75/126 P
3,692,514 9/1972 Hydreau ..... 75/124 BC
3,988,174 10/1976 Kawano ..... 148/12 C
4,279,647 7/1981 Giflo ..... 75/124 B

FOREIGN PATENT DOCUMENTS 51-6813 1/1976 Japan ..... 148/12 C
54-134017 10/1979 Japan ..... 75/124 B
54-39808 11/1979 Japan .

OTHER PUBLICATIONS

Cubberly, W. H., et al.; *Metals Handbook 9th Edition* vol. 1, ASM, Metals Park, Ohio, p. 177 TA472 A3 (1978).

*Primary Examiner*—Michael L. Lewis
*Attorney, Agent, or Firm*—Cushman, Darby & Cushman

[57] ABSTRACT

An enamelling steel sheet comprising not larger than 0.10% carbon, 0.01 to 0.10% aluminum, 0.004 to 0.020% boron, 0.007 to 0.020% nitrogen, the balance being iron and unavoidable impurities.

8 Claims, 1 Drawing Figure

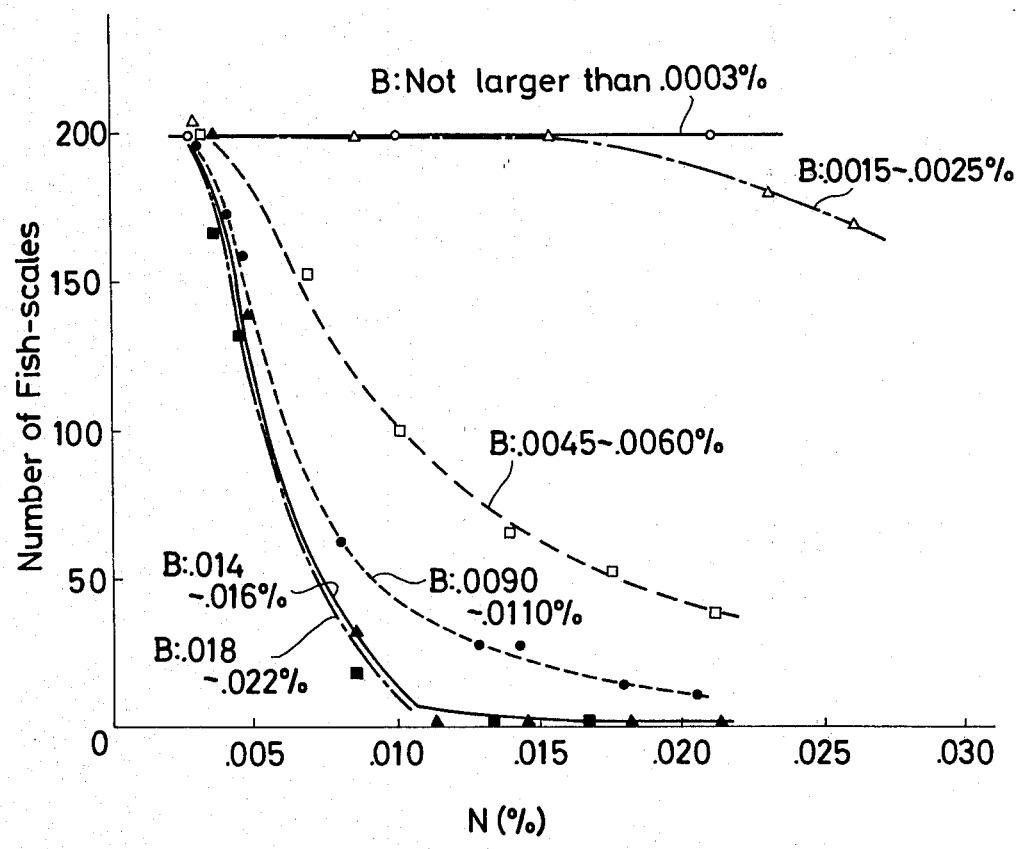
B:Not larger than .0003%
B:0015~.0025%
B:.0045~.0060%
B:.0090
~.0110%
B:.014
~.016%
B:.018
~.022%
Number of Fish-scales
200
150
100
50
0
.005
.010
.015
.020
.025
.030
N (%)

ENAMELLING STEEL SHEET

BACKGROUND OF THE INVENTION

Field of the Invention

The present invention provides an enamelling steel sheet less susceptible to occurrence of fish-scales. The term "enamelling steel sheet" used in the present invention represents a steel sheet material prior to the application of enamel and includes both hot rolled and cold rolled steel sheets.

It is well known when the enamelling steel sheet is enamelled, various surface defects, such as fish-scales, foams and firing strains often appear. The fish-scales in particular appear during a period of several days to several months after the firing of the enamel, and once they appear, they are very hard, if not at all impossible, to eliminate. Much money and labour are required for the remedy.

Therefore, strong demands have been made for an enamelling steel sheet free from occurrence of the fish-scales.

It has been generally accepted that the fish-scales are caused by a large amount of atomic hydrogen being absorbed into the steel sheet from the enamel glaze and the moisture within the firing furnace during the firing of the enamel at high temperatures. Thus, as the temperature of the enamelled steel sheet is lowered, the solubility of the hydrogen in the steel sheet decreases and the hydrogen collects together in the interlayer between the enamel layer and the steel sheet in the form of molecular hydrogen under a high pressure, thus breaking the enamel film formed by the firing process and exploding out of the enamelled steel sheet to cause the fish-scales on the sheet surface.

Therefore, in order to prevent the occurrence of fish-scales, it will be necessary to decrease the moisture which is the source of hydrogen in the firing furnace or to prevent hydrogen from being absorbed into the steel sheet or to entrap the absorbed hydrogen within the steel sheet.

Various studies have been made from the aspects as mentioned above, and enamelling steel sheets, particularly cold rolled steel sheets, having excellent resistance to occurrence of fish-scales have been developed. Most of these conventional enamelling steel sheets are produced utilizing non-metallic inclusions, such as oxides and sulfides in the steel, which cause formation of a large number of small voids in the steel during the cold rolling, thereby increasing the hydrogen absorbing capacity of the steel sheet. These conventional arts have been found to be very effective with respect to cold rolled steel sheets, but quite less effective with respect of hot rolled steel sheets, and no practically useful hot rolled enamelling steel sheets not susceptible to the occurrence of fish-scales have been realized.

Recently an improved enamelling steel sheet has been developed as disclosed in Japanese Patent Publication Sho 54-39808 in which restricted amounts of boron and oxygen are added to form fine boron oxides so as to increase the hydrogen absorbing capacity. However, it has been found that it is very difficult in a commercial production by this prior art to assure a desired relation between the restricted contents of boron and oxygen, and that this prior art cannot provide satisfactory hot rolled enamelling steel sheet.

Therefore, under the present status of art up to now, although the cold rolled enamelling steel sheets can be nowadays enamelled on both sides satisfactorily, most of the hot rolled enamelling steel sheets are enamelled only on one side and it is very difficult to enamel the hot rolled enamelling steel sheets on both sides.

SUMMARY OF THE INVENTION

According to the present invention, there is provided an enamelling steel sheet containing suitable amounts of boron and nitrogen and showing a very excellent resistance to the occurrence of fish-scales, which is a result of various extensive studies made by the inventors from both aspects of the steel composition and the production process for developing an enamelling steel sheet, particularly a hot rolled enamelling steel sheet which is much less susceptible to the occurrence of fish-scales than the conventional enamelling steel sheets.

The basic steel composition according to the present invention comprises (by weight) up to 0.1% of carbon, 0.01 to 0.10% of aluminum, 0.004 to 0.020%, preferably 0.008 to 0.015% of boron, and 0.007 to 0.020%, preferably 0.010 to 0.017% of nitrogen, the balance being iron, incidental ingredients and unavoidable impurities.

According to the conventional enamelling steel sheet arts, the steel contains only about 0.006% or less of nitrogen, but according to the present invention, nitrogen is intentionally added to the steel in an amount not less than 0.007% and simultaneously boron is added in an amount not less than 0.004%.

Carbon tends to increase the firing strain during the firing of the enamel and deteriorate the press-formability of the enamelled product. Therefore, it is desirable to maintain the carbon content as low as possible, and in the present invention the carbon content is limited up to 0.10%.

Aluminum, which is used as a deoxidizer in the melting step, fixes the oxygen in the steel to enhance the effect of the boron addition and simultaneously fixes the nitrogen in the steel to improve the press-formability and the non-aging property of the resultant steel sheet, when present in an amount not less than 0.010%. However, when aluminum is present in excessive amounts, the nitrogen combines with the aluminum rather than with the boron, resulting in decrease of boron nitride to be formed, and hence in deterioration of the resistance to the occurrence of fish-scales, and a preferred maximum aluminum content is 0.10%.

Boron combines with nitrogen to form boron nitrogen (BN) in the steel during the continuous casting of the molten steel, or the ingot-making and break-down steps as well as in the hot rolling step, and thereby remarkably improves the resistance to the occurrence of fish-scales of the steel sheet when present in an amount not less than 0.004%. On the other hand, when too much boron is present, hot-work cracking of the steel is caused during the hot rolling step, and furthermore the press-formability of the steel sheet is deteriorated. Thus a preferred maximum boron content is 0.020%.

Nitrogen combines with boron to form boron nitrides in the steel and thereby contributes to improve the fish-scale preventing property of the steel sheet. All ordinary steels prepared in a converter and so on usually contains about 0.001 to 0.006% of nitrogen as an unavoidable impurity. It will be appreciated that according to the present invention nitrogen is intentionally added to the steel in an amount not less than 0.007% so as to give the steel an excellent resistance to the occurrence of fish-scales. It has been found that a larger nitrogen content can give a better resistance to the occurrence of fish-scales. Particularly for the hot rolled enamelling steel sheet, a preferred minimum nitrogen content is 0.010%. However, the cold formability of the steel can be deteriorated by too much nitrogen, and a preferred maximum nitrogen content is 0.020%.

Regarding other elements, such as manganese for example, manganese may be present in amounts ranging from 0.1 to 0.5% as usually added in ordinary steels for the purpose of preventing the hot cracking.

The unavoidable impurities, such as silicon, phosphorus, and sulfur should preferably be maintained as low as possible. However, where high-strength steel sheets are required, one or more of 0.10 to 2.0% Si, 0.60 to 2.0% Mn, 0.1 to 2.0% Cr and 0.05 to 0.15% P may be added without deviating from the scope of the present invention.

All of silicon, manganese, chromium and phosphorus can increase the strength of the steel without damaging the enamelling property and the resistance to the occurrence of fish-scales, and particularly when a tensile strength not less than 40 kg/mm$^2$ is desired, it will be necessary to add one or more of these elements in amounts not less than 0.10% for Si, not less than 0.60% for Mn, not less than 0.10% for Cr and not less than 0.05% for P, otherwise the resultant tensile strength is not as high as desired.

On the contrary, too much of these elements will markedly deteriorate the press-formability of the steel sheet despite the markedly increased strength, and the maximum silicon, manganese and chromium contents are 2.0% and the maximum phosphorus content is 0.15%.

For the purpose of lowering the strength of the steel and simultaneously improving the press-formability of the steel, elements such as silicon, manganese, chromium and phosphorus should preferably be maintained as low as possible.

It will be appreciated that the enamelling steel composition as described above may be subjected to the ordinary ingot-making and break-down steps or to the ordinary continuous casting step into a slab. The steel composition may be adjusted by deoxidation with aluminum or silicon which is added prior to addition of boron. When the carbon content is desired to be lowered, a conventional vacuum degassing treatment may be applied. The steel slab thus obtained is heated to a temperature ranging from 1000° to 1300° C. and subsequently hot rolled. In this case, it is unnecessary to cool the slab to a low temperature close to the room temperature after the break-down or the continuous casting, but the hot slab may be directly charged in the heating furnace. Furthermore, the slab which is at a high temperature immediately after the continuous casting may be directly hot rolled without heating in the heating furnace.

Also regarding the finishing temperature in the hot rolling, it is not always necessary to be a temperature not lower than the $Ar_3$ point, but it has only to be not lower than 700° C.

The hot rolled steel sheet thus obtained is then, if necessary, further subjected to a temper rolling or levelling to obtain a final product. For the production of cold rolled enamelling steel sheets, the steel sheet as hot rolled is descaled and cold rolled with a reduction rate ranging from 30 to 95%, and annealed at a temperature not lower than 500° C.

Regarding the annealing method, a tight-coil or open-coil type box-annealing or a rapid-heating annealing, for example, a continuous annealing may be applied.

In the open-coil type box-annealing, the steel may be decarburized by using a wet hydrogen atmosphere. The resultant cold rolled enamelling steel sheet is, if necessary, subjected to temper rolling or levelling to obtain a final product.

By way of illustration only, the invention will be described in greater detail and certain specific examples set out, reference being made to the accompanying drawing.

BRIEF EXPLANATION OF THE DRAWING

The attached drawing shows the influences of boron and nitrogen contents on the resistance to the occurrence of fish-scales of hot rolled steel sheets.

EXAMPLE 1

On a laboratory scale, steel slabs containing
C: 0.003 to 0.010%
Si: 0.03% or less
Mn: 0.20 to 0.40%
P: 0.01 to 0.03%
S: 0.01 to 0.03%
Al: 0.01 to 0.05%
B: 0.025% or less
N: 0.002 to 0.025%
are prepared, and hot rolled into slabs of 20 mm in thickness, heated to the temperature range of from 1100° to 1300° C., then again hot rolled into sheets of 4.5 mm in thickness with a finishing temperature of 900° C.

The hot rolled steel sheets thus obtained are subjected to a double enamel firing. The number of the fish-scales on the both sides of the enamelled steel sheets (100 mm×150 mm) are shown in the attached drawing.

As clearly understood from the results shown in the drawing, a large number of fish-scales take place irrespective of the nitrogen content if the boron content is less than 0.0020%, but the number of fish-scales tends to remarkably decrease with a nitrogen content of 0.007% or larger when the boron content is 0.0040% or larger. With a boron content of 0.010% or larger and a nitrogen content of 0.010% or larger, no fish-scale appears. In this way, the resistance to the occurrence of fish-scales can be markedly enhanced by the synergic effect of the boron content and the nitrogen content. With an increased boron content alone, or with an increased nitrogen content alone, the desired results cannot be achieved.

The synergic effect of the boron content and the nitrogen content may be attributed to the following assumed facts. Thus, if the nitrogen content is as low as usually contained in ordinary steels, the precipitate of boron nitride (BN) is small in amount, but as the nitrogen content increases the nitride precipitates more easily so that most of the boron nitrides precipitate during the cooling step of the steel slab after the continuous casting or the breaking-down, and during the heating step prior to the hot rolling, and these precipitates cause strains in the interlayer between the steel and the enamel film during the enamel firing to give the steel a sufficient absorbing ability to absorb the hydrogen, thus improving the resistance to the occurrence of fish-scale.

EXAMPLE 2

Steel compositions as shown in Table 1 are prepared in a converter and continuously cast into slabs, which are heated to a temperature ranging from 1100° to 1300° C., and then hot rolled into hot rolled steel sheets of 2.5 mm in thickness. Subsequently, these hot rolled steel sheets are descaled, cold rolled into 0.8 mm in thickness, and subjected to a softening annealing, such as the tight-coil annealing, the open-coil decarburization annealing and the continuous annealing, and further subjected to a skin-pass rolling with 1% reduction to obtain final cold rolled enamelling steel sheets.

Table 1 represents the analyses of the hot rolled steel sheets, and the values in the parentheses show the analyses of the cold rolled steel sheets after the open-coil decarburization annealing.

Table 2 shows the number of fish-scales on the both sides of the enamelled sheets (100 mm×150 mm) obtained by applying a double enamel firing to both of the above hot rolled steel sheets and the cold rolled steel sheets, and also shows the hydrogen permeation times measured on the cold rolled steel sheets. The hydrogen permeation time represents the time required for the atomic hydrogen which has been absorbed by electrolysis into the one side surface of the steel sheet to reach the other side surface of the steel. A longer hydrogen permeation time represents a less number of the fish-scales.

It will be appreciated both from the above Examples that the number of fish-scales is very small in the steel sheets within the scope of the present invention as compared with the steel sheets outside the scope of the present invention, and this tendency is still more remarkable in connection with the hot rolled steel sheets.

TABLE 1

| Steel Sheet No. | C | Si | Mn | P | S | Cu | Cr | Al | B | N |
|---|---|---|---|---|---|---|---|---|---|---|
| 1* | 0.003 | 0.03 | 0.23 | 0.012 | 0.016 | 0.04 | 0.01 | 0.023 | 0.0083 | 0.0089 |
| 2* | " | " | " | " | " | " | " | " | " | " |
| 3* | 0.005 | " | 0.35 | 0.020 | 0.025 | " | " | 0.030 | 0.0130 | 0.0138 |
| 4* | " | " | " | " | " | " | " | " | " | " |
| 5* | " | " | 0.16 | " | 0.030 | " | " | 0.050 | 0.0171 | 0.0160 |
| 6* | 0.041 | " | 0.20 | 0.015 | 0.016 | " | " | 0.042 | 0.011 | 0.010 |
| 7* | 0.041 (0.003) | " | " | " | " | " | " | " | " | " |
| 8* | 0.007 | 0.51 | 1.30 | 0.020 | " | " | " | 0.050 | 0.0120 | 0.012 |
| 9* | 0.007 | 0.04 | 0.40 | 0.10 | " | " | " | 0.040 | 0.013 | 0.011 |
| 10* | 0.052 | 0.42 | 0.50 | 0.011 | 0.016 | " | 0.36 | 0.062 | 0.016 | 0.014 |
| 11 | 0.003 | 0.03 | 0.32 | 0.023 | 0.011 | " | 0.01 | 0.051 | 0.0060 | 0.0050 |
| 12 | 0.052 | 0.02 | 0.28 | 0.015 | 0.015 | " | 0.01 | 0.071 | tr | 0.0030 |

*Present Invention

TABLE 2

| | | Hot Rolled Steel Sheet | | | Cold Rolled Steel Sheet | | | | | |
|---|---|---|---|---|---|---|---|---|---|---|
| | | | Mechanical Properties | | | | | Mechanical Properties | | |
| Steel Sheet No. | Slab Heating Temp. (°C.) | Number of Fish-Scales | Yield Strength (kg/mm²) | Tensile Strength (kg/mm²) | Annealing Conditions** (°C.) | | Number of Fish-Scales | Yield Strength (kg/mm²) | Tensile Strength (kg/mm²) | Hydrogen Permeation Time (min.) |
| 1* | 1150 | 50 | 16.2 | 30.1 | Box Annealing | 700 | 0 | 14.8 | 27.8 | 14 |
| 2* | " | 45 | " | " | Continuous Annealing | 700 | 0 | " | 28.5 | 16 |
| 3* | 1250 | 0 | 15.8 | 30.8 | Box Annealing | 700 | 0 | 15.0 | 29.5 | 20 |
| 4* | " | 0 | " | " | Continuous Annealing | 800 | 0 | 16.0 | " | 25 |
| 5* | " | 0 | 16.7 | 30.2 | Box Annealing | 700 | 0 | 15.5 | 30.0 | 30 |
| 6* | " | 21 | 21.2 | 30.8 | " | 700 | 0 | 20.2 | 31.2 | 15 |
| 7* | " | 16 | " | " | (Decarburization) | 700 | 0 | 16.2 | 28.5 | 14 |
| 8* | " | 0 | 26.1 | 37.1 | " | 700 | 0 | 24.6 | 35.1 | 16 |
| 9* | 1150 | 5 | 23.1 | 37.8 | " | 700 | 0 | 21.2 | 36.2 | 18 |
| 10* | " | 0 | 21.2 | 36.0 | " | 700 | 0 | 20.9 | 34.5 | 26 |
| 11 | 1250 | more than 200 | 16.9 | 30.5 | " | 700 | 100 | 15.2 | 29.3 | 4 |
| 12 | " | " | 20.5 | 31.8 | " | 700 | more than 200 | 19.2 | 31.2 | 1 |

*Present Invention
**Holding Time: 4 hours for the box annealing and one minute for the continuous annealing

What is claimed is:

1. An enamelling steel sheet consisting essentially of not larger than 0.10% carbon, 0.023 to 0.10% aluminum, 0.004 to 0.020% boron, 0.0089 to 0.020% nitrogen, the balance being iron and unavoidable impurities wherein combined boron and nitrogen effectively resist fish-scales.

2. An enamelling steel sheet according to claim 1 in which the boron content is from 0.008 to 0.015% and the nitrogen content is from 0.010 to 0.017%.

3. An enamelling steel sheet consisting essentially of not larger than 0.10% carbon, 0.023 to 0.10% aluminum, 0.004 to 0.020% boron, 0.0089 to 0.020% nitrogen, and one or more of 0.1 to 2.0% silicon, 0.50 to 2.0% manganese, 0.1 to 2.0% chromium and 0.05 to 0.15% phosphorus, the balance being iron and unavoidable impurities wherein combined boron and nitrogen effectively resist fish-scales.

4. An enamelling steel sheet according to claim 3 in which the boron content is from 0.008 to 0.015% and the nitrogen content is from 0.010 to 0.017%.

5. An enamelling steel sheet according to claim 3 wherein there is present 0.1 to 2.0% of chromium.

6. An enamelling steel sheet according to claim 3 wherein there is present 0.05 to 0.15% phosphorus.

7. An enamelling steel sheet consisting essentially of 0.003 to 0.052% carbon, 0.023 to 0.062% aluminum, 0.008 to 0.0171% boron, 0.0089 to 0.0160% nitrogen, 0.03 to 0.51% silicon, 0.16 to 1.30% manganese, 0.01 to 0.36% chromium, 0.020 to 0.10% phosphorus, the balance being iron and unavoidable impurities.

8. An enamelling steel sheet according to claim 7 containing 0.04% copper and 0.016 to 0.030% sulfur.

* * * * *